US008469291B2

(12) United States Patent
Foster et al.

(10) Patent No.: US 8,469,291 B2
(45) Date of Patent: Jun. 25, 2013

(54) LOW COST TRIGGER SPRAYER

(75) Inventors: Donald Dean Foster, St. Charles, MO (US); Philip Luther Nelson, Wildwood, MO (US)

(73) Assignee: MeadWestvaco Calmar, Inc., Richmond, VA (US)

( * ) Notice: Subject to any disclaimer, the term of this patent is extended or adjusted under 35 U.S.C. 154(b) by 239 days.

(21) Appl. No.: 13/105,224

(22) Filed: May 11, 2011

(65) Prior Publication Data

US 2012/0286069 A1 Nov. 15, 2012

(51) Int. Cl.
*A62C 11/00* (2006.01)

(52) U.S. Cl.
USPC ..... 239/333; 239/337

(58) Field of Classification Search
USPC ..... 239/333, 337, 331, 349, 353, 569, 239/574, 302
See application file for complete search history.

(56) References Cited

U.S. PATENT DOCUMENTS 4,558,821 A * 12/1985 Tada et al. ..... 239/333
4,669,664 A * 6/1987 Garneau ..... 239/333
4,728,009 A * 3/1988 Schmidt ..... 222/321.9
4,815,663 A * 3/1989 Tada ..... 239/333
4,958,754 A * 9/1990 Dennis ..... 222/383.1
5,341,967 A * 8/1994 Silvenis ..... 222/376

* cited by examiner

*Primary Examiner* — Davis Hwu

(74) *Attorney, Agent, or Firm* — MWV Intellectual Property Group

(57) ABSTRACT

A trigger sprayer has a housing, a piston bore within the housing, and a piston reciprocally mounted with the piston bore. The housing further includes a flow passage through which liquid passes from a passage inlet to a passage outlet. An actuator is operable to reciprocate the piston within the piston bore between a vacuum stroke creating reduced pressure in the piston bore and a compression stroke creating increased pressure in the piston bore. A valve unit within the flow passage controls the flow of liquid through the flow passage upon operation of the actuator. The valve unit further comprises a check valve and priming valve. The check valve is shaped in a frusto-conical manner and is assembled into the check valve seat which is not part of the housing but is a separate component. The sprayer has a free spinning threaded type closure for mounting the sprayer to a container, the closure formed separately from and secured to said housing.

5 Claims, 4 Drawing Sheets

LOW COST TRIGGER SPRAYER

BACKGROUND

The invention pertains to trigger sprayers. More particularly, the invention pertains to a low cost all plastic trigger sprayer.

Figure 1:
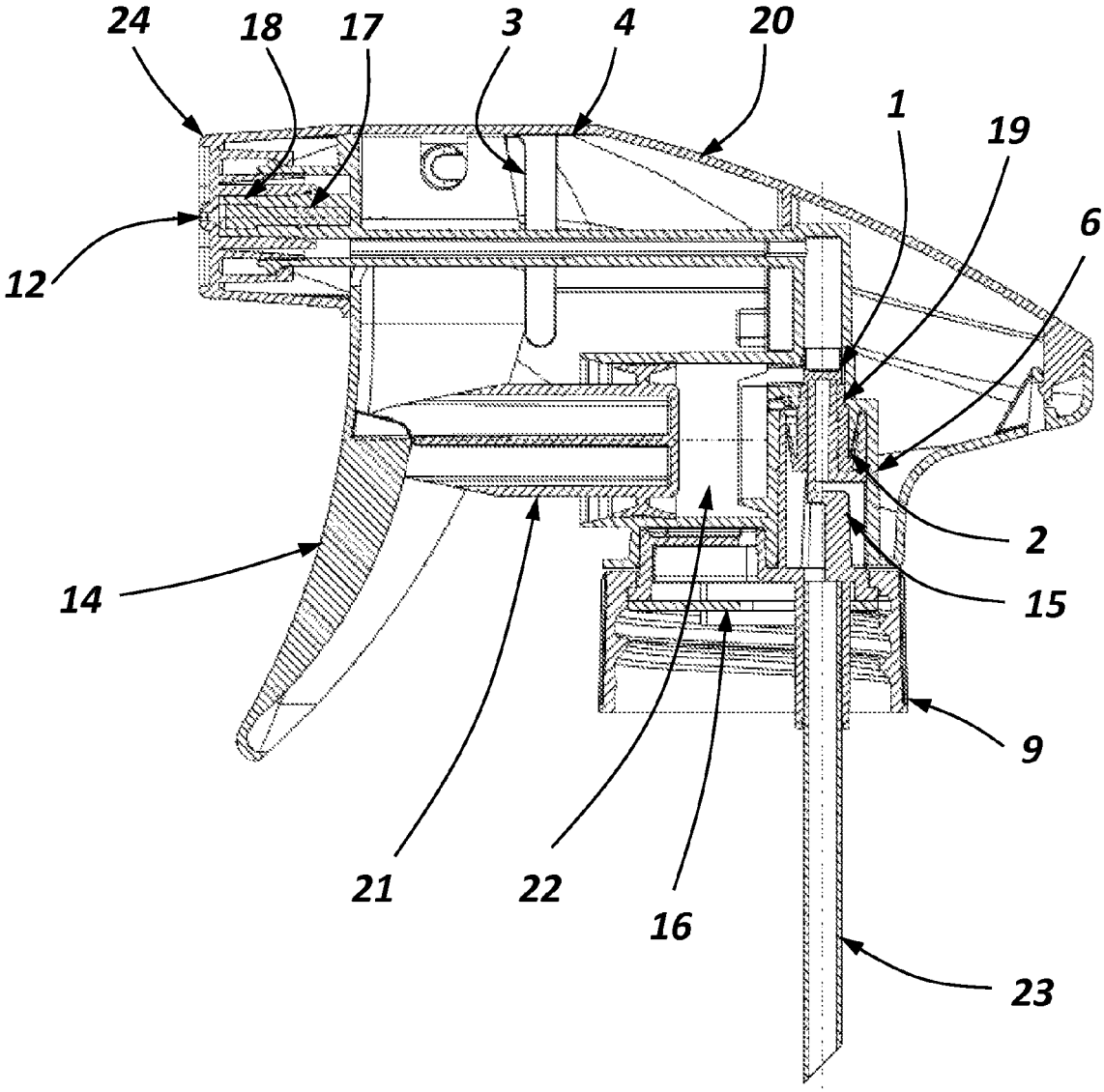
FIG. 1 is a side cross section of a trigger sprayer incorporating the present invention.
Figure 2:
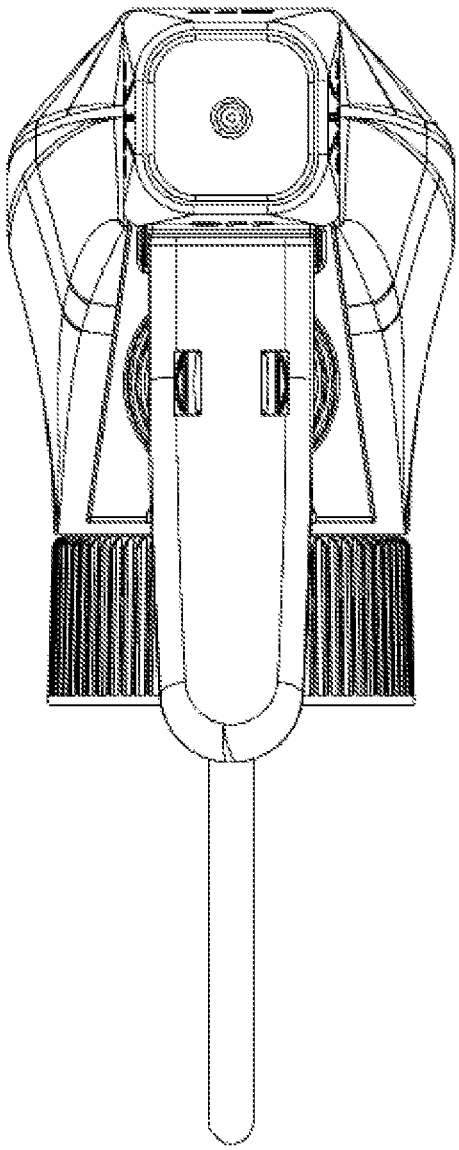
FIG. 2 is a front elevation of the trigger sprayer of FIG. 1
Figure 3:
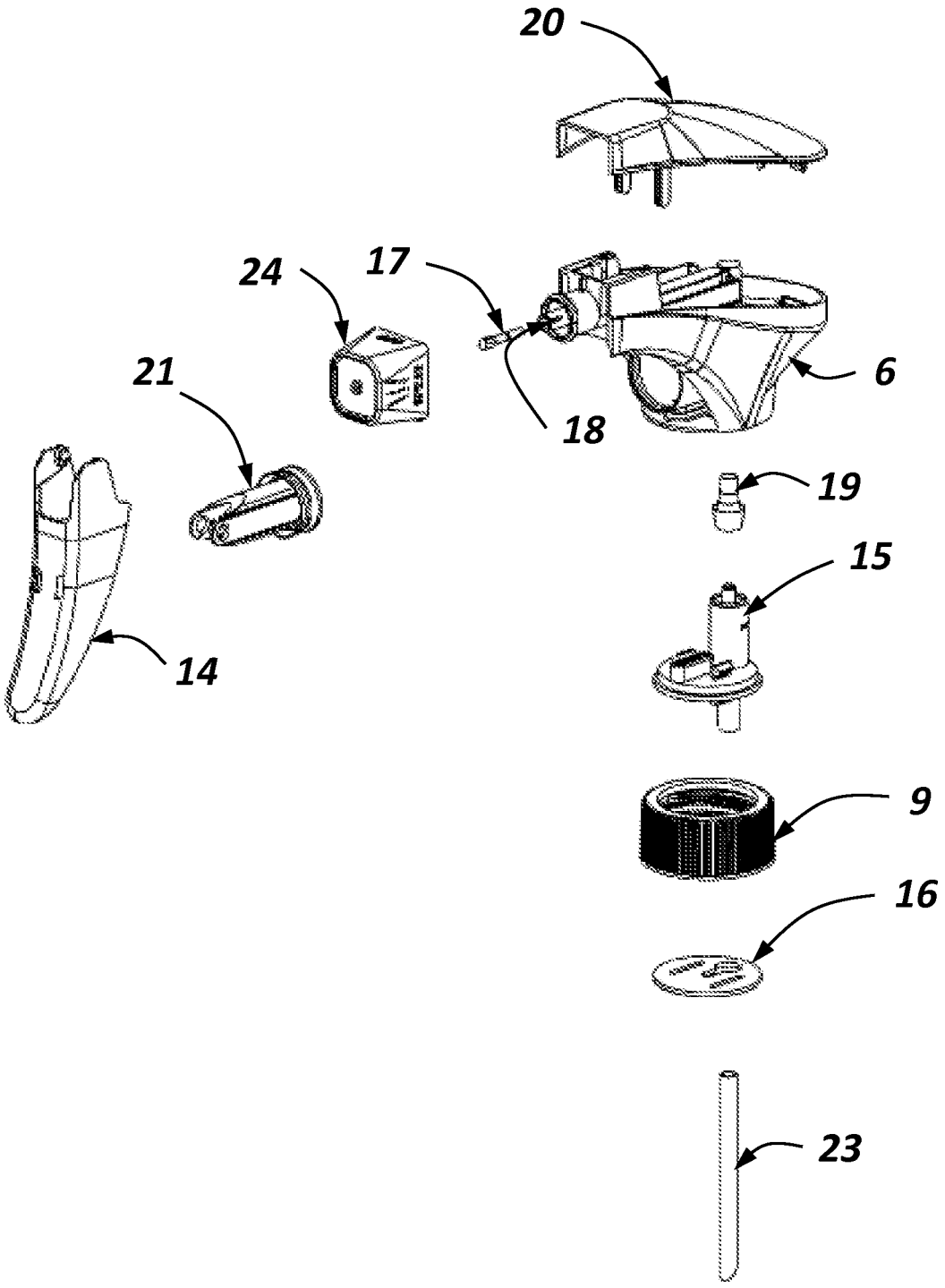
FIG. 3 is an exploded view of the trigger sprayer of FIG. 1
Figure 4:
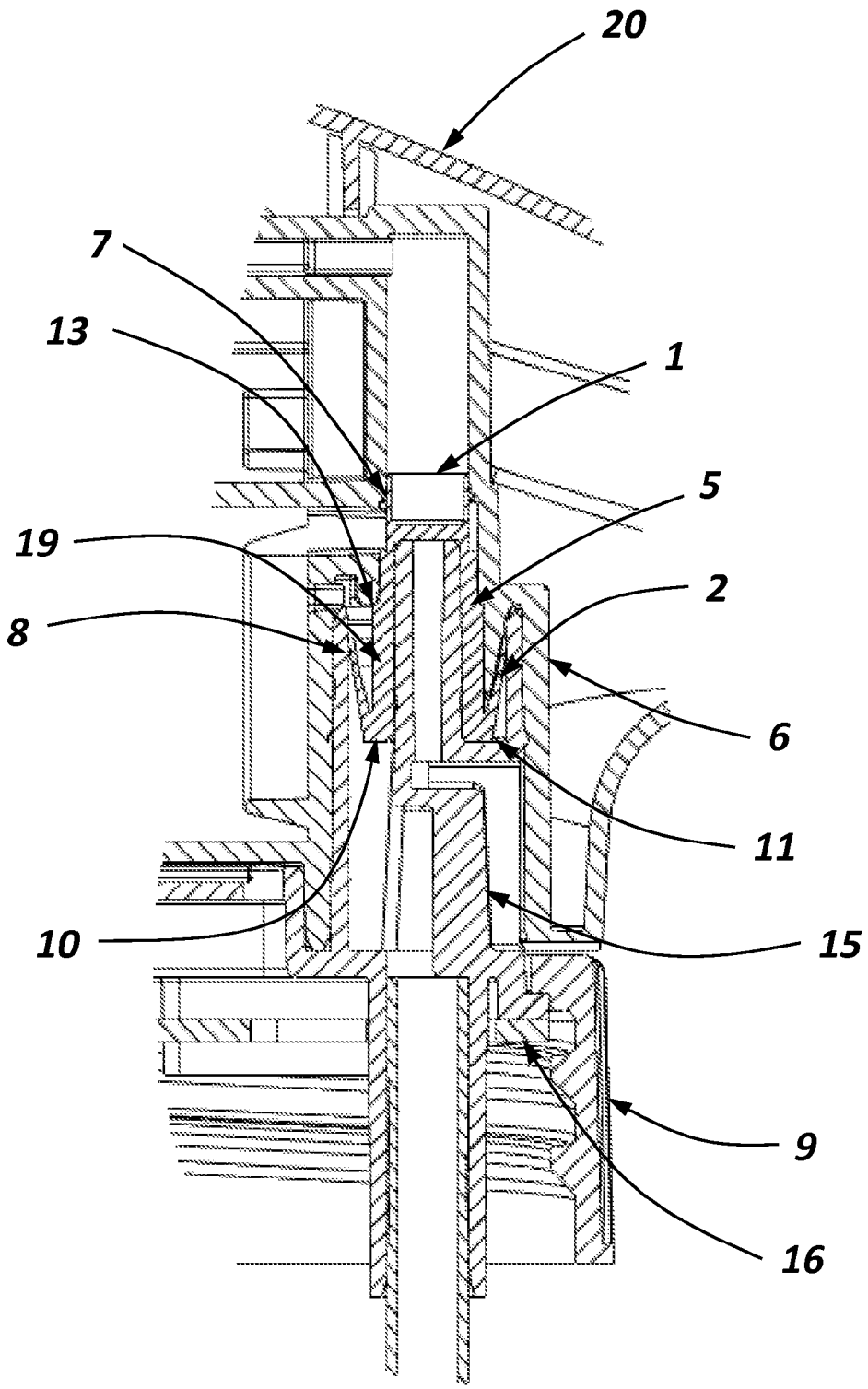
FIG. 4 is an enlarged cross section of the portion of FIG. 1 housing the valve unit.

Reference numbers in the written specification and in the drawing figures indicate corresponding items.

DETAILED DESCRIPTION

The low cost trigger sprayer shown in the drawings figures is made of all plastic materials and can be manufactured to dispense in a large range of outputs. This design can be used to dispense many liquid products from household chemicals, lawn and garden products, automotive products, etc. It is an open and closed opposing valve system using a one-piece piston 21 for compressing the liquid that is drawn into the piston bore area 22. The dip tube 23 is used to pull the liquid from the container into the piston chamber. Once the liquid is drawn into the piston chamber past the check valve 2, the piston is pushed back into the bore by the actuator closing the check valve and opening the priming valve 1 which forces the liquid into the nozzle 24 compressing the liquid again inside of the swirl chamber which now becomes a spray, stream or foam depending on the type of configuration of the swirl chamber when the liquid is expelled through the nozzle orifice 12.

The low cost trigger sprayer shown in the drawing figures has a plastic return spring 3 which is molded or attached mechanically to the top of the internal surface 4 of the trigger sprayer cover component 20. When the plastic spring structure 3 is assembled into the housing 6, it provides a bias against the actuator 14 to force the return of the actuator to its at-rest position after each compression of the stroke.

The low cost trigger sprayer shown in the drawing figures includes a one-piece valve system 19 for priming and check valve functions. The top portion 1 of the valve 19 (priming function) is shaped in a straight diameter tube and the lower portion 2 of the valve 19 (check function) is shaped in a frusto-conical manner. The stepped portion 5 of the one-piece valve system 19 provides a stop ,against the inside surface 13 of the housing 6 which positions the one-piece valve system 19 in the correct relationship to the priming valve area 1 and mating valve seat area 7 in the housing component 6, as well as the check valve area 2 and the mating valve seat area 8 in the valve case component 15. Designing the priming valve seat area 7 in the housing 6 and the check valve seat area 8 in a separate component valve case 15 is of great benefit for molding, assembly and improved quality performance which also reduces manufacturing cost. The surface 10 on the lower portion of the one-piece valve system 19 assembles against surface 11 of the valve case component 15, thereby insuring that the stepped portion 5 of the one-piece valve system 19 is in the correct position to surface 13 of the housing component 6.

The low cost trigger sprayer shown in the drawing figures includes a free spinning threaded closure component 9 to secure the trigger to the bottle. The closure component 9 being a separate component and not part of the housing or any outside shroud component, allows for changing the diameter of the closure component 9 easily to accommodate different bottle neck sizes.

The low cost trigger sprayer shown in the drawing figures includes a swirl component 17 to provide mechanical break-up of the fluid for spraying, steaming or foaming and is designed as a simple easily manufactured component tubular in shape which allows for easy assembly into the housing component 6. The tubular shape also eliminates excess clearance inside of the area 18 of the housing 6 providing an exceptional spray, stream or foam delivery.

This low cost all plastic trigger sprayer is designed to use minimum plastic and components to reduce weight and manufacturing cost with high quality.

The function of the trigger sprayer is evident from the forgoing description. Upon pulling the trigger actuator 14 in the compression stroke, the pressure in the piston bore 22 increases forcing the check valve 2 to close against check valve seat 8 thereby preventing the flow of liquid to go down the dip tube 23 and back into the container, and to open the priming valve 1 to allow liquid in the piston bore 22 to flow to the sprayer nozzle and exit orifice 12. Upon releasing the trigger actuator 14 on the return stroke (vacuum stroke), the priming valve 1 closes against valve seat 7 creating reduced pressure in the piston bore 22 which opens the check valve 2 causing the liquid from the container to flow up and through the dip tube 23 into the piston bore 22. Forming the check valve seat 8 in the valve case 15 rather than in the sprayer housing 6 greatly facilitates assembly of the valve unit 19 with the sprayer housing. Assembly of the valve unit 19 and the valve case 15 with the closure 9 attached into housing 6 can be accomplished with high speed automated equipment by either first inserting the valve unit 19 into the housing 6, and then assembling the valve case 15 with the closure 9 attached into the housing 6, or by preassembling the valve case unit 19 (check valve 2) first into the valve case 15 with the closure 9 attached creating a sub assembly, and then inserting the sub assembly into the housing 6. With either way of assembly there is no interference created between the check valve frusto-conical shape of valve unit 19 and the wall of the housing 6 that would cause the check valve 2 to jamb upon its insertion into the housing 6.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A sprayer comprising:

a housing, said housing having a piston bore;

a piston reciprocally mounted within said piston bore;

a flow passage within the housing for the passage of liquid from a passage inlet to a passage outlet;

an actuator operable to reciprocate the piston within the piston bore between a vacuum stroke that is configured and adapted to create reduced pressure in the piston bore and a compression stroke that is configured and adapted to create increased pressure in the piston bore;

a valve assembly within the flow passage for controlling the flow of liquid through the flow passage upon operation of the actuator, said valve assembly further comprising a check valve and a priming valve; the check valve comprising a frusto-conical component;

a valve case formed separately from and operatively connected to said housing, a valve seat for the check valve formed within the valve case; and a closure that is configured and adapted to mount the sprayer to a container, said closure formed separately from said housing and formed separately from and operatively connected to said valve case.

2. The sprayer of claim 1 wherein the closure is of the threaded type that may be rotated relative to the valve case for attachment to a container.

3. The sprayer of claim 1 wherein the priming valve and check valve are integrally molded as a one-piece unit.

4. The sprayer of claim 3 wherein the priming valve comprises a straight diameter tubular component.

5. The sprayer of claim 4 wherein the closure is of the threaded type that may be rotated relative to the valve case for attachment to a container.

* * * * *